US005259075A

United States Patent [19]

Cutler

[11] Patent Number: 5,259,075

[45] Date of Patent: Nov. 9, 1993

[54] WATER-SAVING DEVICE FOR A WATER CLOSET

[75] Inventor: William Cutler, Flanders, N.J.

[73] Assignee: Niagara Conservation Corp., Flanders, N.J.

[21] Appl. No.: 836,236

[22] Filed: Feb. 18, 1992

[51] Int. Cl.[5] ..... E03D 9/00

[52] U.S. Cl. ..... 4/415; 4/661

[58] Field of Search ..... 4/415, 227.1, 227.2, 4/227.4, 277.5, 227.6, 228.1; 383/23, 66

[56] References Cited

U.S. PATENT DOCUMENTS 2,314,650 3/1943 Madsen ..... 383/66
2,757,699 8/1956 Fancher et al. ..... 383/23
3,877,081 4/1975 Klein ..... 4/415
4,451,941 6/1984 Gray ..... 4/227.4

*Primary Examiner*—Henry J. Recla
*Assistant Examiner*—Charles R. Eloshway
*Attorney, Agent, or Firm*—Ezra Sutton

[57] ABSTRACT

A water-saving device for the tank of a water closet, wherein a plastic container is filled with water and placed in the tank to reduce the amount of water used on each flush. The container includes a watertight valve for sealing the container to prevent the evaporation of water from the container and a mounting bracket for securely mounting the container on a sidewall of the tank of the water closet.

3 Claims, 2 Drawing Sheets

WATER-SAVING DEVICE FOR A WATER CLOSET

FIELD OF THE INVENTION

The present invention relates to a water-saving device for a water closet.

BACKGROUND OF THE INVENTION

In order to conserve water, various devices have been developed for installation in the tanks of water closets. Matching panels have been used to create a dam within the tanks, and in other cases, containers have been placed in tanks to reduce the amount of water necessary to fill the tanks. Such an example is shown in U.S. Pat. No. 3,877,081. However, the container in this patent has a number of drawbacks. For example, the container is not positively and securely held in position within the toilet tank. Also, water in the container evaporates and has to be refilled.

Accordingly, it is an object of the present invention to provide an improved water-saving device for a toilet tank which is securely held in position within the tank and which is securely sealed to prevent evaporation of water from the water-saving device.

It is a further object of the present invention to provide a simple and secure device for mounting the water-saving device within the toilet tank and which is easy to fill.

SUMMARY OF THE INVENTION

In accordance with the principles of the present invention, a water-saving device is provided having a flexible, collapsible, water impervious, watertight, bag-like container fillable with a fluid and having a front wall and a back wall. A watertight valve is provided on the container for filling the container with a quantity of fluid equal to the quantity by which the volume of water discharged from the tank of the water closet is to be reduced. A removable mounting bracket is connected to the container for mounting the container on a sidewall of the tank.

BRIEF DESCRIPTION OF THE DRAWINGS

Further objects, features, and advantages of the present invention will become apparent upon consideration of the detailed description of the presently-preferred embodiment, when taken in conjunction with the accompanying drawings wherein.

DETAILED DESCRIPTION OF THE PREFERRED EMBODIMENT

Figure 1:
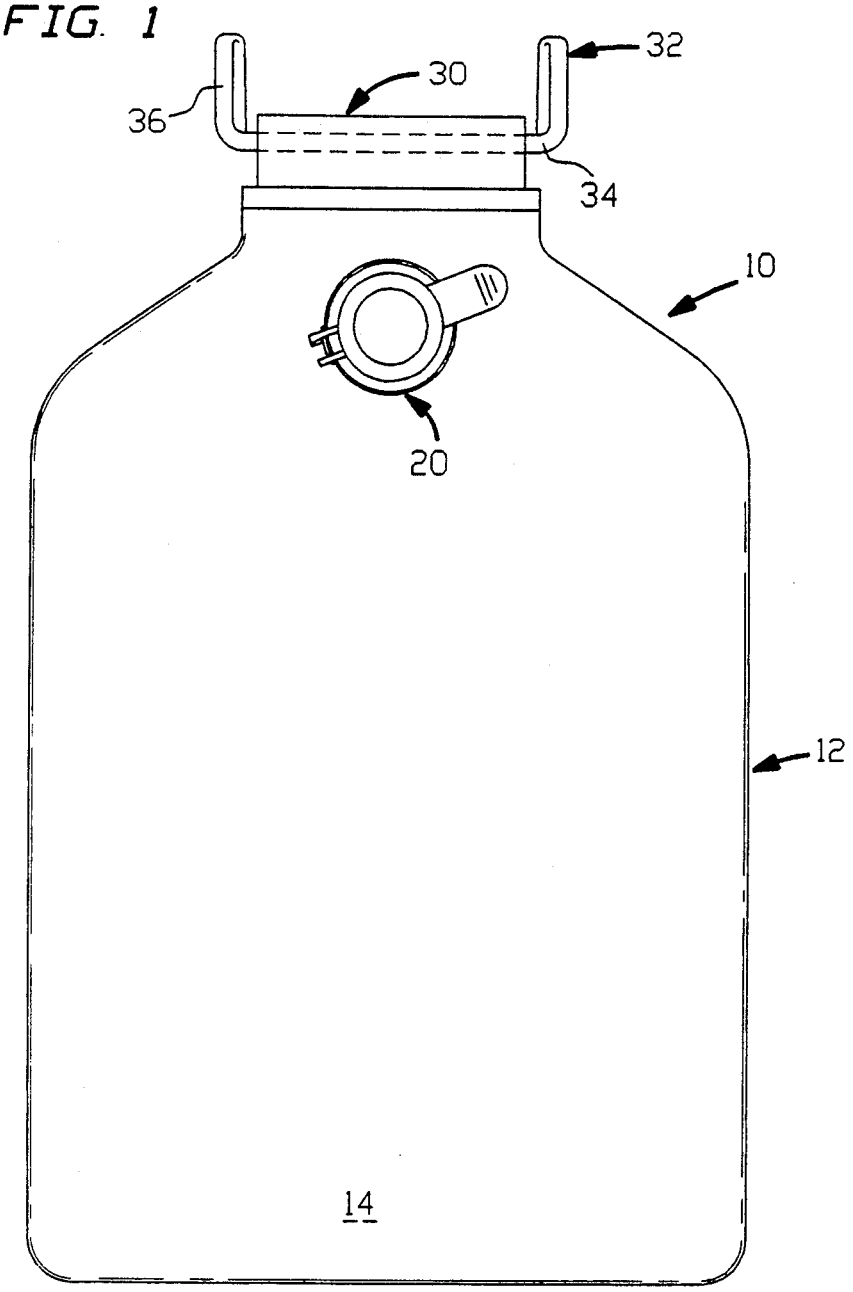
FIG. 1 is an elevational view of the water-saving device of the present invention.

Referring to FIG. 1, there is shown a water-saving device 10 in the form of a flexible, collapsible, watertight, bag-like container 12 having a front wall 14 and a back wall 16.

A watertight valve 20 is disposed on the upper portion of front wall 14 of the container 12 for filling container 12 with a quantity of water or fluid equal to the quantity by which the volume of water discharged from the tank of the water closet is to be reduced. Typically, the container 12 may hold a gallon of water or less, depending on the amount of water to be saved. Valve 20 substantially prevents evaporation of the water or fluid from container 12 so that it does not have to be refilled.

Figure 2:
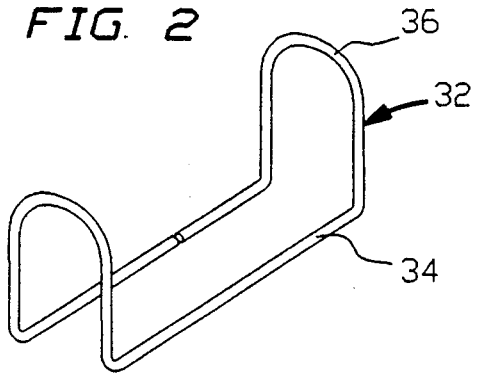
FIG. 2 is a perspective view of the hook.
Figure 3:
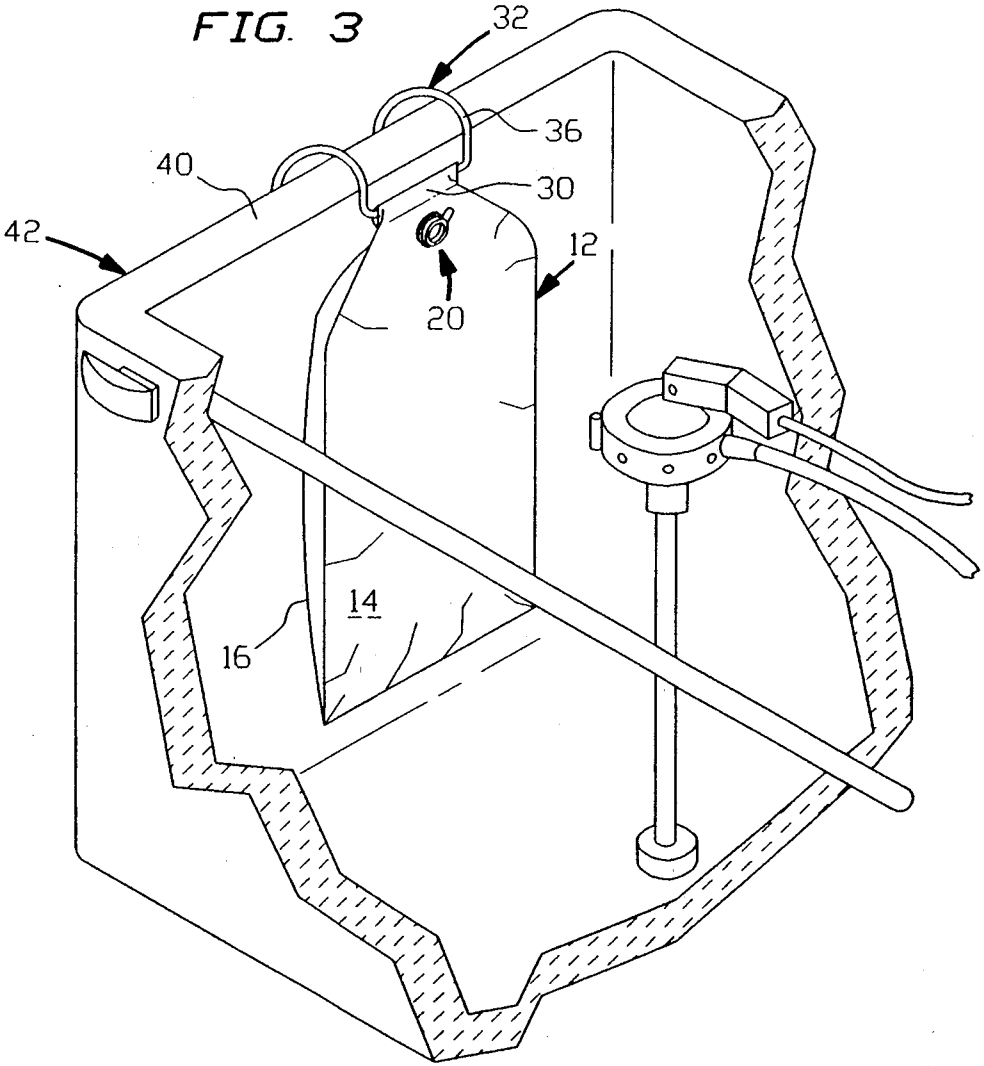
FIG. 3 is a perspective view showing the water-saving device mounted on the wall of the tank in a water closet.

The upper end of container 12 is also provided with a circular-shaped sleeve 30 integrally formed with the container 12 for receiving a mounting bracket 32. The mounting bracket 32 includes a rod 34, which passes through sleeve 30 and also includes a hook-shaped member 36 for engaging the top edge of the sidewall 40 of the toilet tank 42, as shown in FIG. 2. The mounting bracket 32 is typically formed of stainless steel to prevent corrosion.

In addition, the container 12 is formed of a plastic material which is impervious to water. Other suitable water-impervious materials may also be used.

In use, the container 12 is filled to the fill line, which is adjacent the fill valve 20. The valve 20 is closed to seal container 12 and to prevent the water in the container 12 from evaporating. The container 12 is placed in the tank 42 between the sidewall 40 and the intake valve of the tank, and the mounting bracket 32 is used to securely mount the container 12 on the upper edge of sidewall 40. The hook-shaped member 36 of bracket 32 is used to engage the upper edge of sidewall 40. The lid of the tank is then replaced, which helps to maintain mounting bracket 32 from moving.

A latitude of modification, change, and substitution is intended in the foregoing disclosure, and in some instances, some features of the invention will be employed without a corresponding use of other features. Accordingly, it is appropriate that the appended claims be construed broadly and in a manner consistent with the spirit and scope of the invention herein.

What is claimed is:

1. A water-saving device to be disposed in the tank of a water closet, wherein the tank has a sidewall and an upper edge on the sidewall, comprising:

a) a flexible, collapsible, water impervious, watertight, bag-like container fillable with a fluid and having a front wall and a back wall;

b) a watertight vale on said container for filling said container with a quantity of fluid equal to the quantity by which the volume of water discharged from the tank of the water closet is to be reduced;

c) said watertight vale including an opening and a removable closure for sealing said opening to prevent the evaporation of water from said container and for filling said container with water when said removable closure is removed from said opening;

d) a removable mounting bracket connected to said container for mounting the container on the sidewall of the tank; and e) said bag-like container having a sleeve extending across at the upper end thereof for receiving said removable mounting bracket, said bracket having a first portion extending through said sleeve and a second portion configured to be hung over the upper edge of the tank.

2. A water-saving device in accordance with claim 1, wherein said mounting bracket includes a rod for passing through said sleeve and a hook-shaped member for engaging the upper edge of the sidewall of the tank of the water closet.

3. A water-saving device in accordance with claim 1, wherein said watertight vale includes a removable plastic closure which is press-fit into said opening.

* * * * *

UNITED STATES PATENT AND TRADEMARK OFFICE

CERTIFICATE OF CORRECTION

PATENT NO. : 5,259,075

DATED : November 9, 1993

INVENTOR(S) : William Cutler

It is certified that error appears in the above-identified patent and that said Letters Patent is hereby corrected as shown below:

Claim 1, column 2, line 41, change "vale" to --valve--.

Claim 1, column 2, line 45, change "vale" to --valve--.

Claim 3, column 2, line 65, change "vale" to --valve--.

Signed and Sealed this

Twelfth Day of April, 1994

Bruce Lehman

*Attest:*

BRUCE LEHMAN

*Attesting Officer*

*Commissioner of Patents and Trademarks*